US005189865A

United States Patent [19]

Andrade et al.

[11] Patent Number: 5,189,865

[45] Date of Patent: Mar. 2, 1993

[54] METHOD AND APPARATUS FOR WRAPPING AN ARTICLE

[75] Inventors: Jose A. Andrade, Sunrise; Leonard A. Watts, Hallandale, both of Fla.

[73] Assignee: IDAB Incorporated, Hialeah, Fla.

[21] Appl. No.: 892,954

[22] Filed: Jun. 3, 1992

[51] Int. Cl.[5] ..... B65B 11/08

[52] U.S. Cl. ..... 53/466; 53/228; 53/389.2

[58] Field of Search ..... 53/466, 228, 229, 389.2, 53/389.3

[56] References Cited

U.S. PATENT DOCUMENTS

| | | | |
|---|---|---|---|
| 2,890,555 | 6/1959 | Hayssen . | |
| 3,307,327 | 3/1967 | Liedtke . | |
| 3,715,861 | 2/1973 | Odelberg | 53/389.3 X |
| 4,043,096 | 8/1977 | Wallis . | |
| 4,385,479 | 5/1983 | Focke | 53/228 X |
| 4,541,225 | 9/1985 | Byland | 53/466 X |
| 5,009,055 | 4/1991 | Simmons . | |
| 5,042,640 | 8/1991 | Goizueta et al. . | |

FOREIGN PATENT DOCUMENTS

| | | | |
|---|---|---|---|
| 923002 | 4/1963 | United Kingdom . | |
| 993199 | 5/1965 | United Kingdom | 53/466 |

*Primary Examiner*—John Sipos

*Attorney, Agent, or Firm*—Finnegan, Henderson, Farabow, Garrett & Dunner

[57] ABSTRACT

An article wrapping device feeds an article to be wrapped on a conveyor in a generally horizontal direction. A sheet of wrapping material is fed upward from beneath the conveyor to intersect the path of the article. The sheet of wrapping material is maintained in a generally vertical orientation by a flow of forced air between the sheet of wrapping material and a generally vertical displaceable wall suspended alongside the path of the sheet of wrapping material. As the article intersects the sheet of wrapping material and the displaceable wall, the wall is displaced, and forces a leading edge of the sheet of wrapping material over a top side of the article.

16 Claims, 7 Drawing Sheets

METHOD AND APPARATUS FOR WRAPPING AN ARTICLE

BACKGROUND OF THE INVENTION

1. Field of the Invention

The present invention relates to an apparatus and method for wrapping articles.

2. Description of the Related Art

Article wrapping devices are utilized for wrapping articles with a protective wrapper, such as paper, plastic foil or the like. Article wrapping devices are widely used in the publishing industry to wrap bundles of signatures, such as newspapers or magazines. Article wrapping devices have also been used to package consumer products.

A conventional wrapping device which is widely used in the publishing industry is a three-sided bottom wrapper. Bundles of signatures to be wrapped are conveyed on a series of generally horizontal successive conveyor belts. A roll of wrapping paper is positioned beneath the conveyor belts.

At a selected time, the roll feeds a leading edge of the wrapping paper upward through a feed slot between two of the successive conveyors. A mechanical gripping apparatus grips the leading edge of the wrapping paper with a clamp, and lifts it upwards with a hydraulic or pneumatic cylinder. The wrapping paper is thus lifted in an orientation which is generally perpendicular to the path of the oncoming bundle of signatures. When the bundle intersects the wrapping paper, the leading edge of the wrapping paper is released by the clamp, and drapes over a top side of the bundle. Simultaneously, a cutting device below the conveyors slices the dispensed wrapping paper from the roll. The trailing end of the dispensed wrapping paper is dragged beneath the bundle by its continued passage on the conveyor belts past the feed slot.

The mechanical gripping apparatus used to lift the sheet of wrapping material significantly increases the unit cost of the article wrapping device.

Maintaining and replacing such a mechanical gripping apparatus is costly and can result in unacceptable down time for the entire article wrapping device while the mechanical gripping device is maintained or overhauled.

The mechanical gripping apparatus also slows the throughput rate of the wrapping device. When a bundle has been wrapped and is exiting the device, the mechanical gripping apparatus must be lowered to grip the next sheet of wrapping paper to wrap the next bundle. This creates "dead time" in the cycle, because no follow-on bundle can be wrapped until the mechanical gripping apparatus is lowered and grips the next sheet of wrapping paper. Throughput of the wrapping device is thus inherently limited by the operation of the mechanical gripping apparatus.

It is an object of the present invention to provide a simple and reliable article wrapping device which does not require a mechanical gripping apparatus to grip the leading edge of the wrapping paper. Deletion of the mechanical gripping apparatus will minimize maintenance, eliminate a source of potential failure, and minimize the overall cost and down-time of the article wrapping device.

It is also an object to provide for increased throughput of the wrapping device, by eliminating the "dead time" associated with the operation of the mechanical gripping apparatus, and allowing a follow-on bundle to enter the device before the previous bundle has exited the device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, an article wrapping device comprises conveyor means for conveying articles to be wrapped along a first path in a generally horizontal direction, feeding means beneath the first path for feeding a sheet of wrapping material upwards along a second path in a generally vertical direction, the second path intersecting the first path, displaceable wall means disposed in a generally vertical orientation across the first path alongside the second path above the feeding means, and air flow means for providing a flow of air along and between the second path and the displaceable wall means to maintain a general orientation of the sheet of wrapping material in the second path.

It is preferable that the article wrapping device further comprise means for dampening oscillatory movement of the displaceable wall means following displacement by the article, thereby allowing the displaceable wall means to be quickly repositioned in the generally vertical orientation following displacement of the displaceable wall means by the article.

It is also preferable that the displaceable wall means comprises a flexible curtain supported from a location above the first path.

BRIEF DESCRIPTION OF THE DRAWINGS

The accompanying drawings, which are incorporated in and constitute part of the specification, illustrate a preferred embodiment of the invention and, together with the general description given above, and the detailed description of the preferred embodiment given below, serve to explain the principles of the invention.

DESCRIPTION OF THE PREFERRED EMBODIMENT

Figure 1:
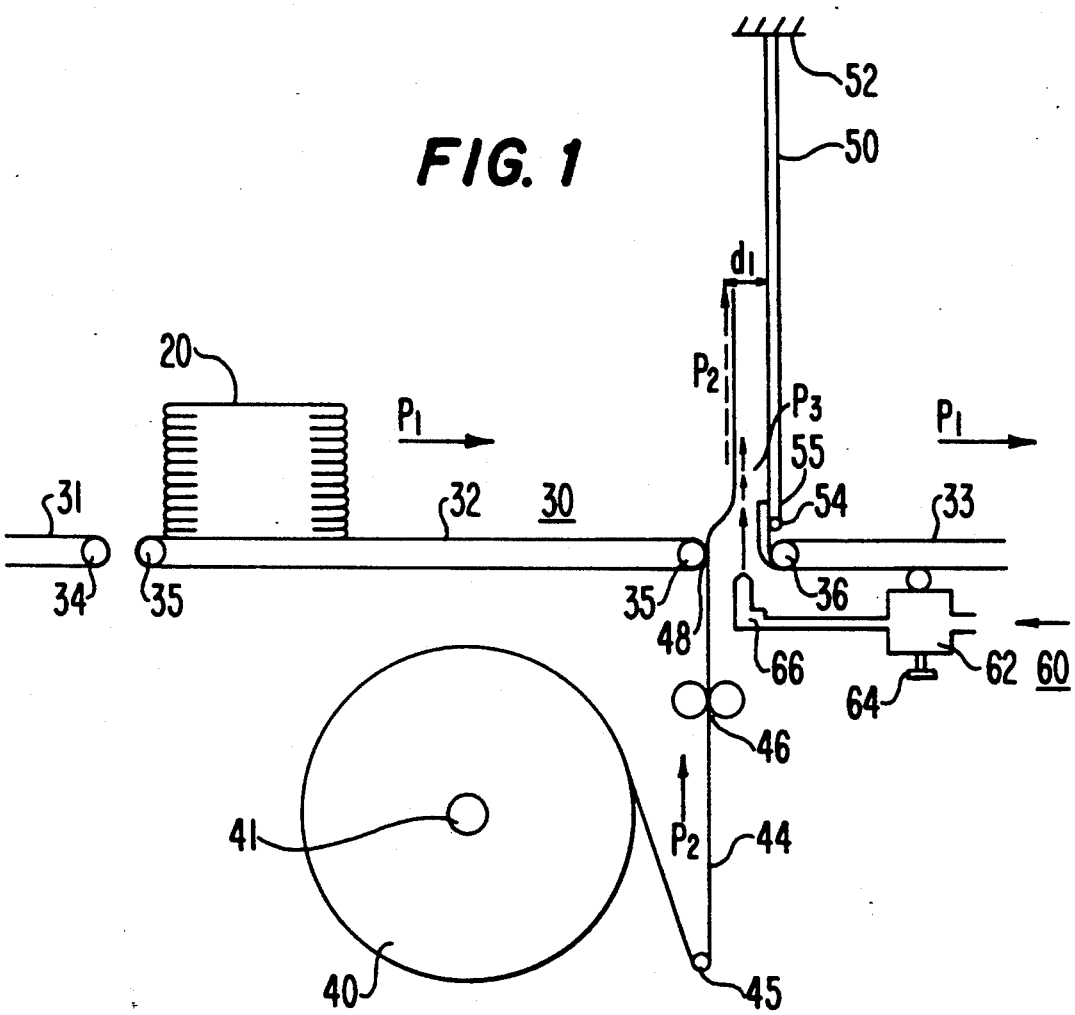
FIG. 1 is a partial side view of a preferred embodiment of an article wrapping device according to the teachings of the present invention.

Reference will now be made in detail to the present preferred embodiment of the invention as illustrated in the accompanying drawings.

According to the present invention, an article wrapping device includes conveyor means for conveying articles to be wrapped along a first path in a generally horizontal direction. As embodied in FIGS. 1 and 2, an article to be wrapped 20, which may be bundle of signatures, is conveyed in a generally horizontal first path P1, on conveyor 30.

Preferably, conveyor 30 includes a plurality of successive conveyor portions 31, 32, 33. As embodied in FIGS. 1 and 2, conveyor portions 31, 32, 33, consist of pairs of successive conveyor belts, rotating on respective sets pulleys 34, 35, 36. However, conveyor 30 is not limited to successive pairs of conveyor belts. Conveyor 30 may include successive chains, rollers, or any of the like devices that are well known in the conveyor art.

According to the present invention, the article wrapping device includes feeding means beneath the first path for feeding a sheet of wrapping material upwards along a second path in a generally vertical direction, the second path intersecting the first path. As embodied in FIG. 1, a roll of wrapping material 40, which may be a roll of kraft paper, is rotatably mounted beneath conveyor 30 on axle 41. A sheet of wrapping material 44 is fed via pulley 45 between nip rolls 46, also disposed beneath conveyor 30, in a generally vertical second path P2.

Preferably, the sheet of wrapping material 44 is fed through a slot 48 between two of the successive conveyor portions. As embodied in FIG. 1, slot 48 is positioned between conveyor portions 32, 33. As sheet of wrapping material 44 penetrates slot 48, it intersects first path P1.

According to the invention, the article wrapping device includes displaceable wall means disposed in a generally vertical orientation across the first path alongside the second path above the feeding means. As embodied in FIG. 1, displaceable wall 50 depends from a bracket 52 suspended above conveyor 30. Displaceable wall 50 hangs in a generally vertical direction, spaced a short distance $d_1$ from the second path P2 of sheet of wrapping material 44.

Figure 2:
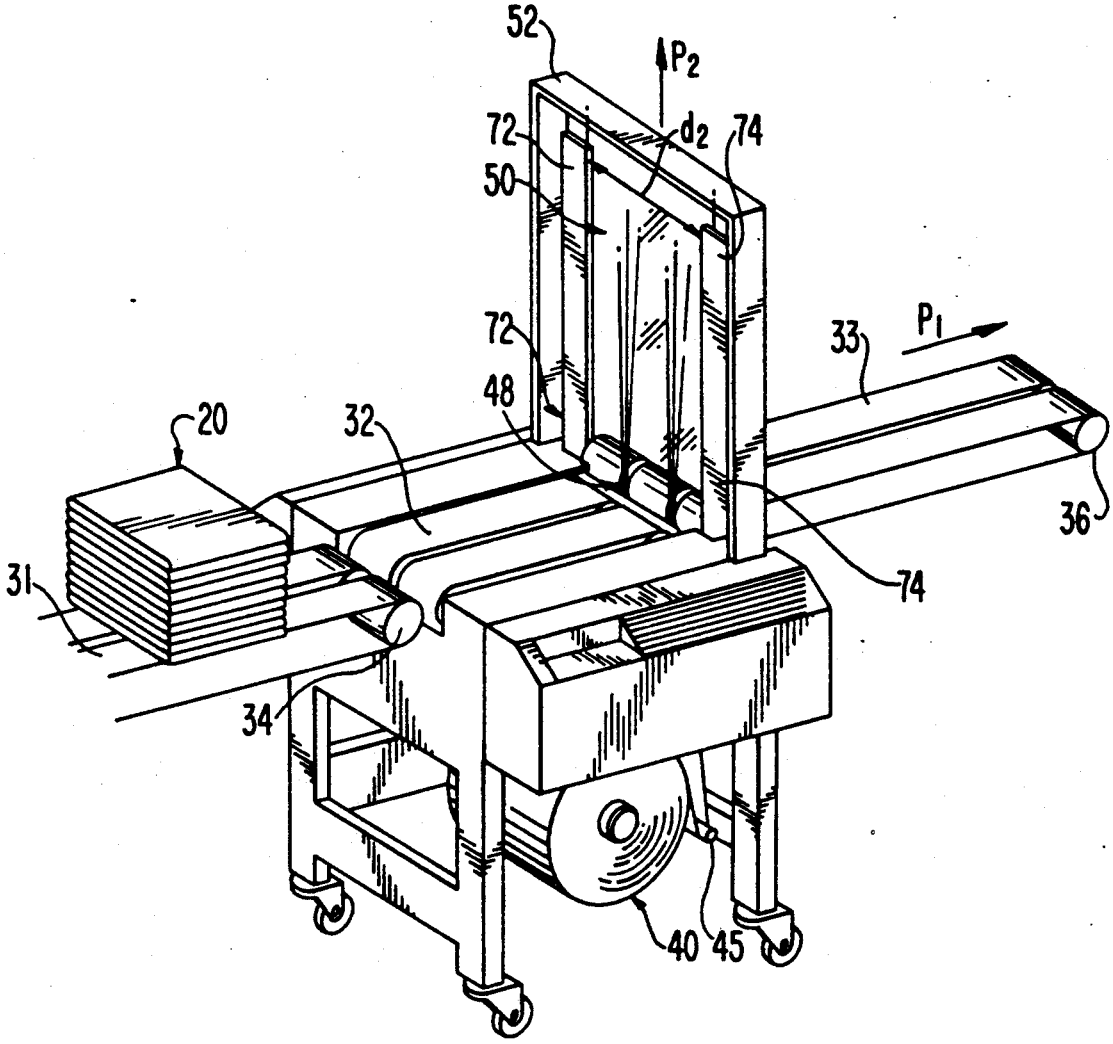
FIG. 2 is a perspective view of the article wrapping device depicted in FIG. 1.

As embodied in FIG. 1, roll 40, nip rolls 46, and slot 48 are positioned relative to displaceable wall 50 so that sheet of wrapping material 44 is fed between the article to be wrapped 20 and displaceable wall 50. In this embodiment, a single displaceable wall 50 is positioned downstream of sheet of wrapping material 44 as it is fed in second path P2. Alternatively, it is within the scope of the invention to provide one displaceable wall upstream of sheet of wrapping material 44, and another displaceable wall downstream of sheet of wrapping material 44.

Preferably, displaceable wall 50 comprises a flexible plastic curtain suspended from bracket 52. It is further preferable that the flexible curtain include a weighted lower edge portion. As embodied in FIG. 1, a rigid rod 54 is attached at lower edge 55 of the curtain. In the embodiment where displaceable wall 50 comprises a flexible curtain, rod 54 functions as a weight which applies tension to the curtain, thereby helping to maintain displaceable wall 50 in its generally vertical orientation.

According to the invention, the article wrapping device includes air flow means for providing a flow of air along and between the second path and the displaceable wall means to maintain a general orientation of the sheet of wrapping material in the second path. As embodied in FIG. 1, a pressurized air source 60 is provided beneath conveyor 60. Pressurized air source 60 may include one or a plurality of air jets 62, including a pressure regulator 64 and a nozzle 66.

Preferably, each nozzle 66 is positioned to direct a flow of forced air in an upward direction generally along third path P3 through slot 48. According to the invention, third path P3 will be between the sheet of wrapping material 44 travelling in second path P2 and the displaceable wall 50.

In this configuration, the flow of forced air enables the article wrapping device to operate without the use of a mechanical gripping apparatus to lift the sheet of wrapping material 44. Sheet of wrapping material 44 will be drawn slightly toward displaceable wall 50 but will remain spaced from displaceable wall 50. This attraction towards displaceable wall 50 enables sheet of wrapping material 44 to maintain its generally vertical orientation, as it continues to be fed upward, without the use of a mechanical gripping apparatus.

Figure 3:
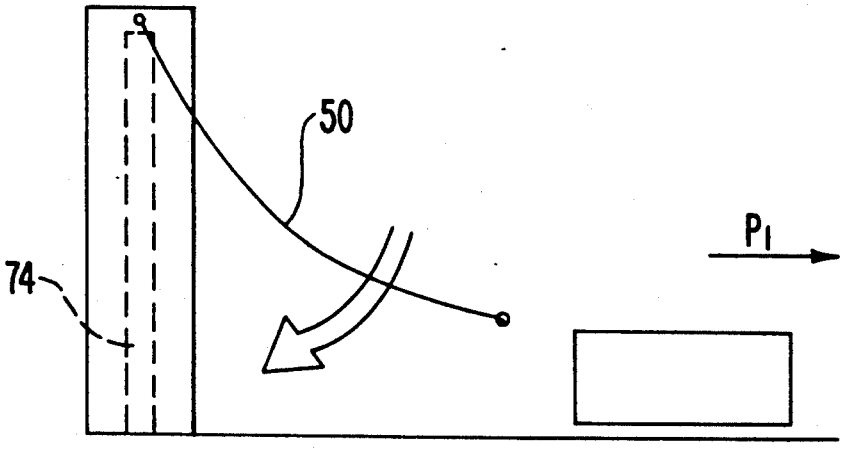
FIG. 3 is a representative side view depicting the displaceable wall means and repositioning means of the device depicted in FIG. 1.

According to the invention, the article wrapping device further includes means for dampening oscillatory movement of the displaceable wall means after being displaced by the article, to assume its original generally vertical orientation. As embodied in FIGS. 2 and 3, wall stopper 70 includes a pair of bars 72, 74, disposed alongside each side of conveyor 30. Bars 72, 74 are positioned in alignment with one another, and spaced apart by a distance $d_2$. Preferably, distance $d_2$ is less than the width of displaceable wall 50. Bars 72, 74 each have a height which is slightly less than the height of displaceable wall 50.

Although not shown or numbered, the article wrapping device further includes means for sensing the article 20 on conveyor 30, and means for cutting sheet of wrapping material 44 from the roll of wrapping material 40. Such means are well known in the article wrapping device art, and will not be discussed further.

An operation of the article wrapping device according to the present invention will now be described. This operation is described with reference to FIG. 1, and more particularly to FIGS. 4–7.

Figure 4:
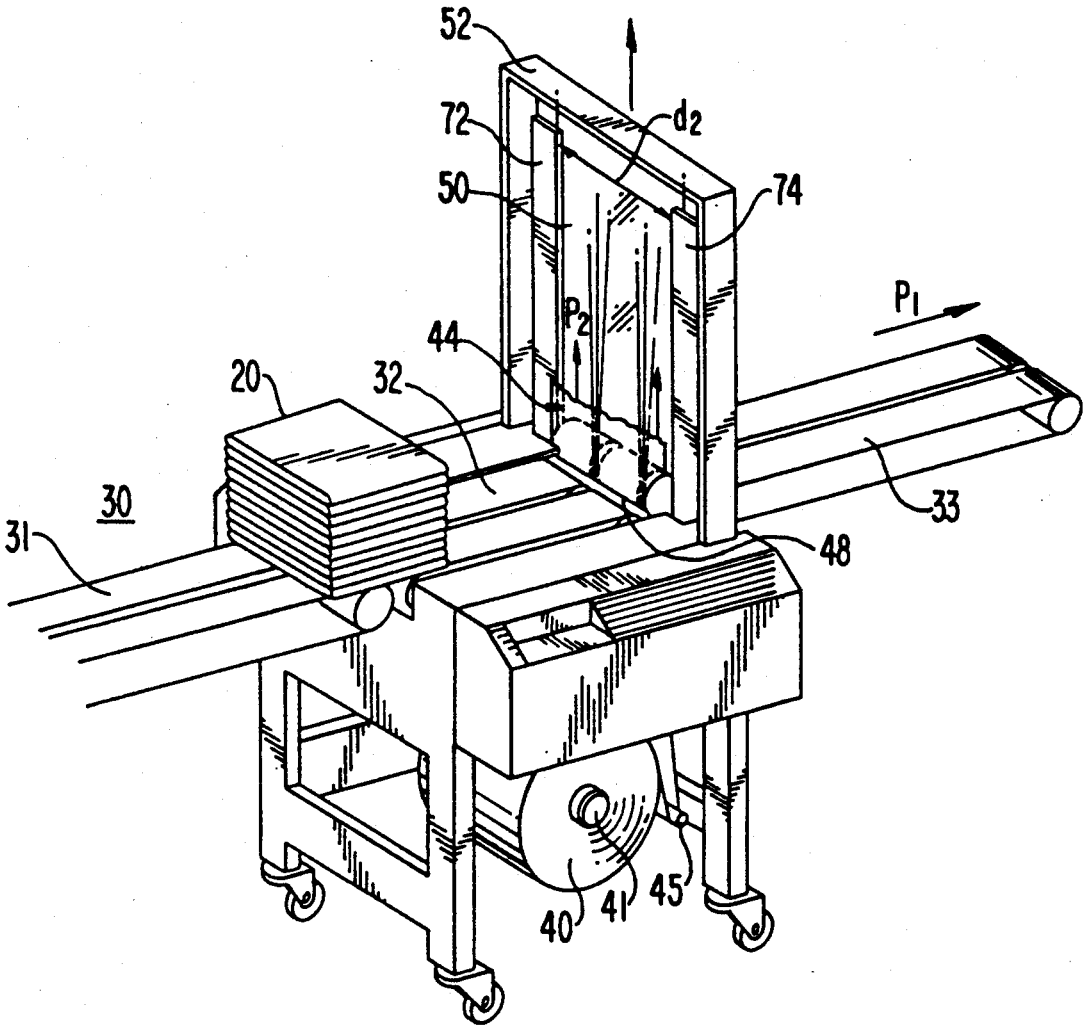
FIGS. 4–7 are perspective views of the device of FIG. 1, showing a sequence of operational steps.

As shown in FIG. 4, article 20, for example a bundle of signatures, is fed to an infeed location on conveyor 30, where it is conveyed in a generally horizontal direction along first path P1 on successive conveyor portions 31, 32, 33. Displaceable wall 50, suspended from bracket 52 above the first path, is oriented in a generally vertical direction intersecting the first path P1.

At a preselected position of article 20 along first path P1, an article sensor (not shown) detects the presence of article 20 and instructs wrapping material roll 40 to commence feeding a sheet of wrapping material 44 about pulley 45 and between nip rolls 46 (not shown in FIG. 4). Sheet of wrapping material 44 is fed in a generally vertical direction in a second path P2. Second path P2 intersects first path P1, and is generally perpendicular to first path P1. As it is fed along second path P2, sheet of wrapping material 44 passes through slot 48, and continues upward alongside displaceable wall 50, approximately a distance $d_1$ from displaceable wall 50.

As sheet of wrapping material 44 passes through slot 48, air jets 62 (not shown in FIG. 4) disposed beneath conveyor 30 are energized. Air jets 62 blow forced air upward through slot 48, between the second path P2 and the displaceable wall 50.

Figure 5:
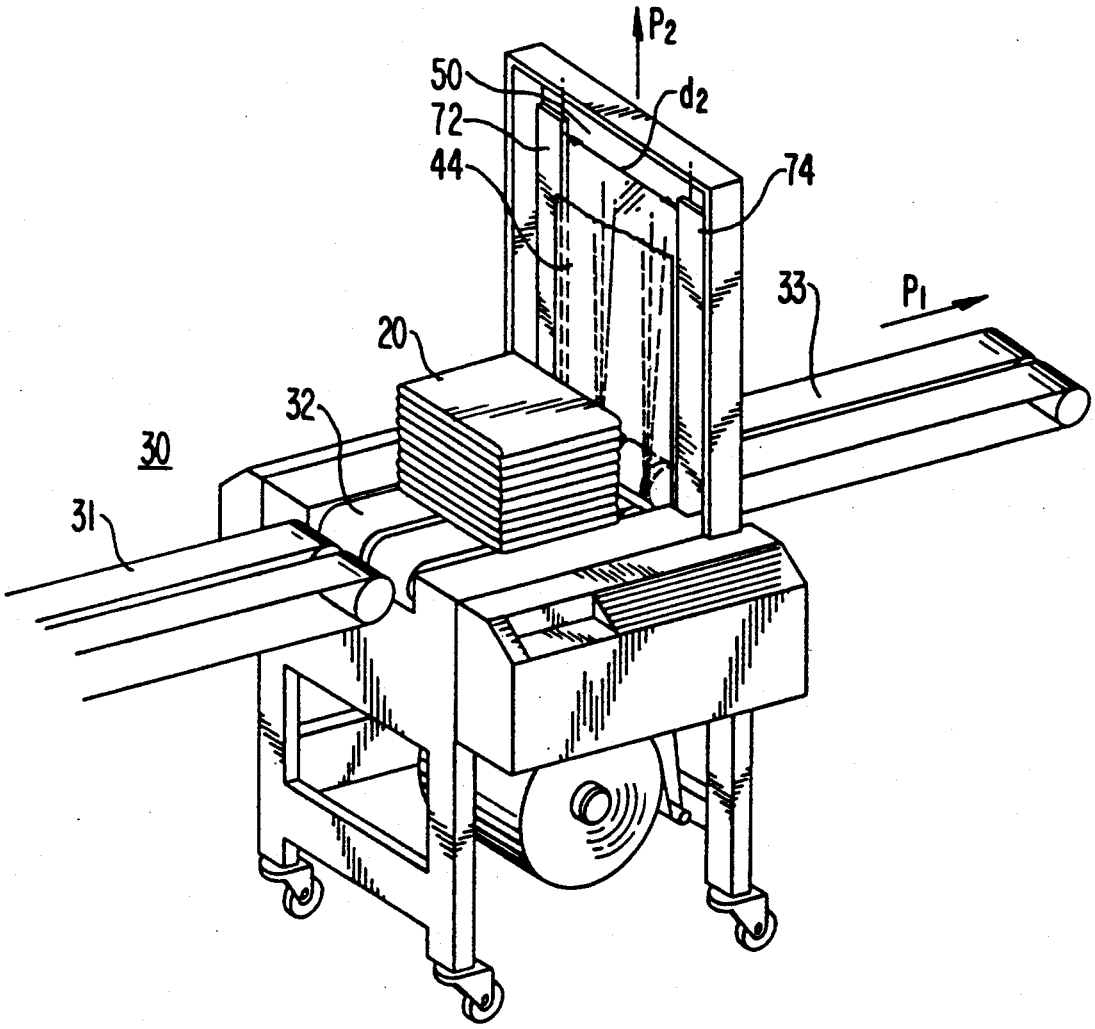

Referring now to FIG. 5, article 20 continues to be conveyed along first path Pl. Sheet of wrapping material 44 has been fed farther along second path P2. The flow of forced air from air jets 62 between the sheet of wrapping material 44 and displaceable wall 50 creates a low pressure area between the sheet of wrapping material 44 and displaceable wall 50. The sheet of wrapping material 44 is slightly attracted towards displaceable wall 50, enabling sheet of wrapping material 44 to maintain its generally vertical orientation.

Figure 6:
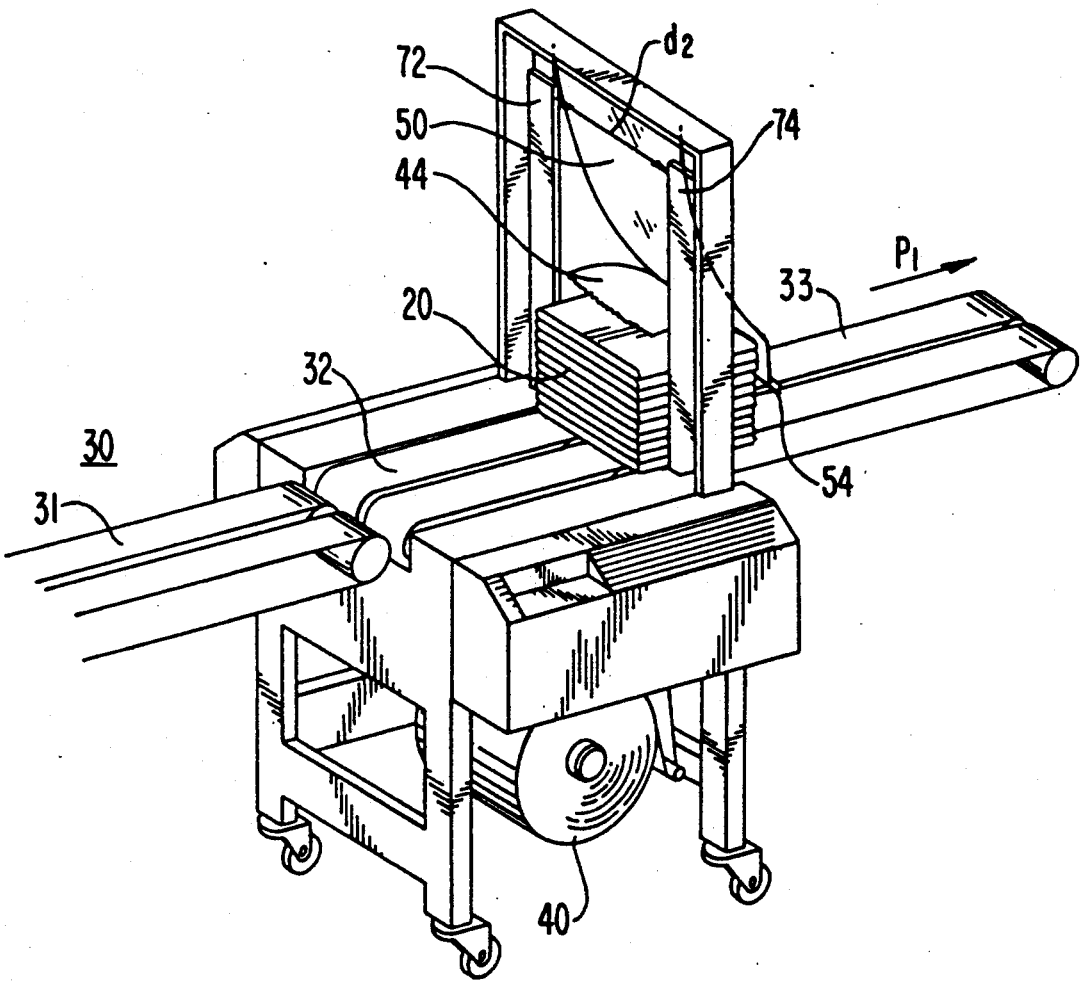

Referring now to FIG. 6, article 20 continues along first path P1 intersecting sheet of wrapping material 44, and next intersecting displaceable wall 50. Displaceable wall 50 is displaced in the direction of the first path P1. As can be seen from FIG. 6, displaceable wall 50, as it is displaced, functions to force a leading edge of the sheet of wrapping material 44 over a top side of article 20. At approximately this time, feed roll 40 stops rotating, and cutting means (not shown) beneath conveyor 30 cut a trailing edge of the sheet of wrapping material 44 from roll 40. At this time, air jets 42 can be deenergized.

Figure 7:
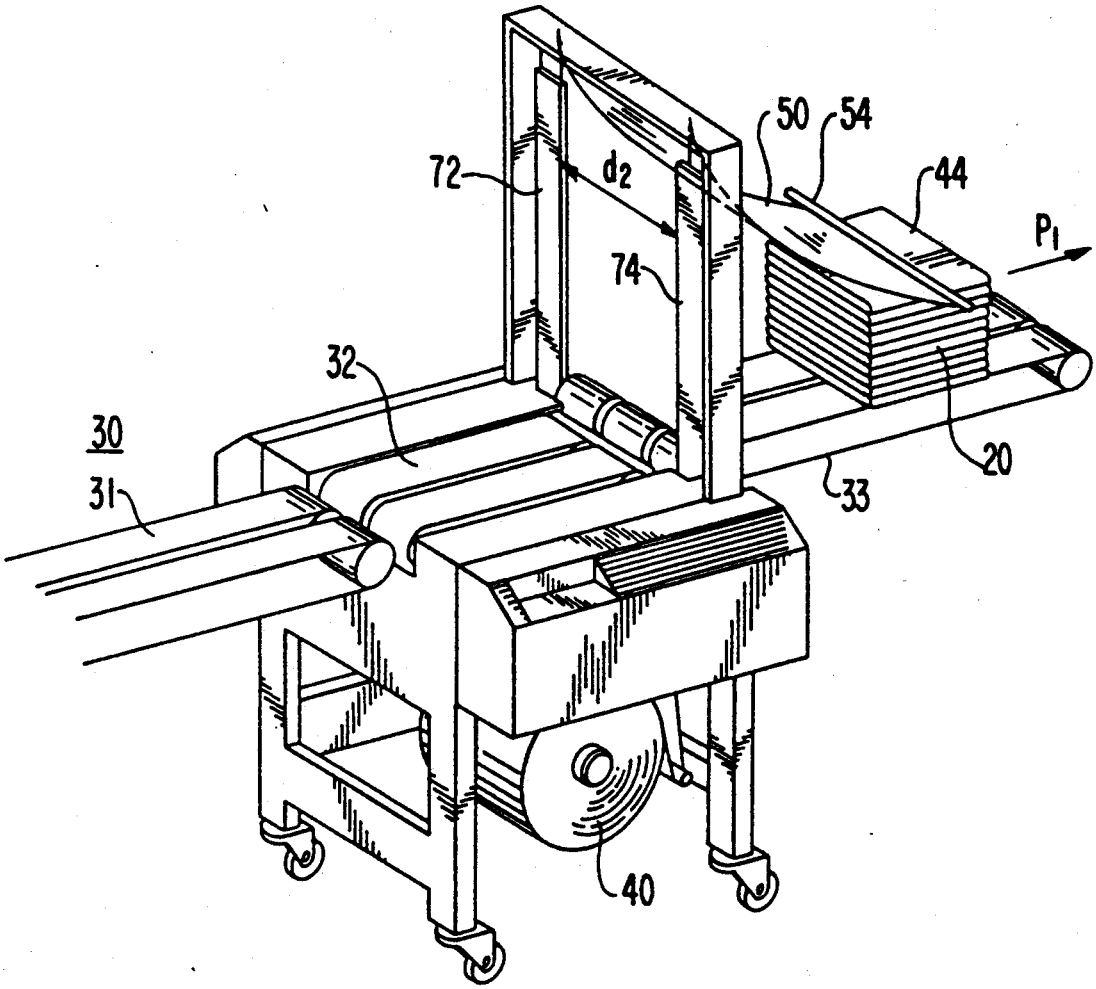

Referring now to FIG. 7, article 20 continues to be conveyed in first path P1. Rod 54 on the trailing edge of displaceable wall 50 passes across the top side of article 20, ensuring the leading edge of sheet of wrapping material 44 is wrapped over the top side. Meanwhile, the trailing edge of sheet of wrapping material 44 wraps around a bottom side of article 20 by the friction of conveyor portion 33, as article 20 continues in the first path P1.

Shortly after the position shown in FIG. 7, the trailing edge 55 of displaceable wall 50 passes over the top side of article 20. Displaceable wall 50 now swings back toward its generally vertical orientation shown in FIG. 4. It will be readily understood that without the presence of the dampening means, wall 50 would oscillate for several seconds before regaining its vertical orientation. This would cause a delay before another article could be converged along first path P1. However, in accordance with the invention, as displaceable wall 50 swings (see FIG. 3), it is quickly repositioned in its generally vertical orientation when bar 54 hits bars 72 74 and the side portions of the curtain come in contact with bars 72 and 74, preventing a wave from oscillating along the length of the curtain. By preventing this oscillation, displaceable wall 50 quickly returns to its original generally vertical orientation, thereby enabling another article 20 to be conveyed along first path P1 in a relatively short period of time.

In the device described above, an article being conveyed on a conveyor in a generally horizontal direction is wrapped by a sheet of wrapping material fed upward from beneath the conveyor. No mechanical gripping apparatus is required to lift the sheet of wrapping material upwards, because the sheet of wrapping material can be maintained in a generally vertical orientation without requiring such a mechanical gripper. Elimination of the mechanical gripping apparatus simplifies the overall design. The need for maintenance and overhaul of the mechanical gripping apparatus is eliminated. Costs and down-time for the entire article wrapping device are significantly reduced.

Furthermore, follow-on bundles can be fed to be wrapped without the "dead time" associated with a mechanical gripping apparatus being lowered to grip the next sheet of wrapping material. Therefore, the throughput rate of the device is increased.

Additional advantages and modifications will readily occur to those skilled in the art. The invention in its broader aspects is therefore not limited to the specific details and representative apparatus shown and described. Accordingly, departures may be made from such details without departing from the spirit or scope of the applicant's general inventive concept.

What is claimed is:

1. An article wrapping device, comprising:

conveyor means for conveying articles to be wrapped along a first path in a generally horizontal direction;

feeding means beneath the first path for feeding a sheet of wrapping material upwards along a second path in a generally vertical direction, the second path intersecting the first path;

displaceable wall means disposed in a generally vertical orientation across the first path alongside the second path above the feeding means and displaceable by the article in the direction of said first path; and air flow means for providing a flow of air along and between the second path and the displaceable wall means to maintain a general orientation of the sheet of wrapping material in the second path.

2. An article wrapping device according to claim 1, wherein the conveyor means includes at least one generally horizontal conveyor for supporting and driving the articles.

3. An article wrapping device according to claim 1, wherein the displaceable wall means comprises a flexible curtain supported from a location above the first path.

4. An article wrapping device according to claim 3, wherein the curtain includes a weighted lower edge portion.

5. An article wrapping device according to claim 1, wherein the displaceable wall means is positioned to direct a leading portion of the sheet of wrapping material over a top side of the article as the article is conveyed along the first path past the displaceable wall means.

6. An article wrapping device according to claim 1, wherein the air flow means comprises a pressurized air source disposed beneath the first path for directing air in an upward direction.

7. An article wrapping device according to claim 1, wherein the air flow means comprises a plurality of air jets disposed beneath the first path for directing air in an upward direction.

8. An article wrapping device according to claim 1, wherein the feeding means is positioned relative to the displaceable wall means for feeding the sheet of wrapping material between the articles to be wrapped and the displaceable wall means.

9. An article wrapping device according to claim 1, further comprising means for dampening oscillatory movement of the displaceable wall means after displacement by the article, for permitting the displaceable wall means to assume its original generally vertical orientation after displacement by the article.

10. An article wrapping device according to claim 9, wherein the dampening mean comprises vertically extending members alongside the second path for buffering the displaceable wall means along a substantial portion of its vertical extent.

11. A method of wrapping articles, comprising the steps of:

conveying an article along a first path in a generally horizontal direction;

feeding a sheet of wrapping material upwards from beneath the first path along a second path in a generally vertical direction, the second path intersecting the first path;

flowing air along and between the second path and a displaceable wall disposed in a generally vertical orientation across the first path alongside the second path above the feeding means, to maintain the sheet of wrapping material in the second path;

displacing the wall with the article as the article is conveyed along the first path past the displaceable wall; and directing a leading portion of the wrapping material over a top side of the article with the displaceable wall as the wall is displaced.

12. A method according to claim 11, wherein the feeding step includes feeding stacks of signatures.

13. A method according to claim 11, wherein the step of flowing air includes forcing air upwards with a pressurized air source disposed beneath the first path.

14. A method according to claim 11, wherein the step of flowing air includes forcing air upwards with a plurality of air jets disposed beneath the first path.

15. A method according to claim 11, wherein the step of displacing the wall includes displacing a flexible curtain suspended from a location above the first path.

16. A method according to claim 11, further comprising a step of dampening oscillatory movement of the wall following displacement by the article by buffering the wall along a substantial portion of its vertical extent with vertically extending members alongside the second path, thereby permitting the wall to assume its original generally vertical orientation following displacement by the article.

* * * * *

UNITED STATES PATENT AND TRADEMARK OFFICE

CERTIFICATE OF CORRECTION

PATENT NO. : 5,189,865

DATED : March 2, 1993

INVENTOR(S) : Andrade et al.

It is certified that error appears in the above-identified patent and that said Letters Patent is hereby corrected as shown below:

Claim 10, column 6, line 55, change "mean" to --means--.

Signed and Sealed this

Fifth Day of July, 1994

Bruce Lehman

*Attest:*

BRUCE LEHMAN

*Attesting Officer*

*Commissioner of Patents and Trademarks*